US008431191B2

(12) United States Patent
Gillesberg et al.

(10) Patent No.: US 8,431,191 B2
(45) Date of Patent: Apr. 30, 2013

(54) METHOD FOR TREATING TITANIUM OBJECTS WITH A SURFACE LAYER OF MIXED TANTALUM AND TITANIUM OXIDES

(75) Inventors: Bo Gillesberg, Augustenborg (DK); Soeren Eriksen, Roskilde (DK)

(73) Assignee: Tantaline A/S, Nordborg (DK)

( * ) Notice: Subject to any disclaimer, the term of this patent is extended or adjusted under 35 U.S.C. 154(b) by 842 days.

(21) Appl. No.: 12/373,634

(22) PCT Filed: Jul. 13, 2007

(86) PCT No.: PCT/DK2007/000360

§ 371 (c)(1),
(2), (4) Date: Nov. 9, 2009

(87) PCT Pub. No.: WO2008/006379

PCT Pub. Date: Jan. 17, 2008

(65) Prior Publication Data

US 2010/0055494 A1 Mar. 4, 2010

(30) Foreign Application Priority Data

Jul. 14, 2006 (DK) ..... 2006 00985

(51) Int. Cl.
*B32B 15/01* (2006.01)
*B05D 5/12* (2006.01)

(52) U.S. Cl.
USPC ..... 427/253; 427/376.6; 427/376.7; 427/376.8; 148/269; 148/281

(58) Field of Classification Search ..... None
See application file for complete search history.

(56) References Cited

U.S. PATENT DOCUMENTS

| | | | | |
|---|---|---|---|---|
| 3,616,445 | A | 10/1971 | Bianchi et al. | |
| 3,632,498 | A | 1/1972 | Beer | |
| 3,929,608 | A | 12/1975 | Degueldre et al. | |
| 4,253,933 | A | 3/1981 | Sato et al. | |
| 4,294,871 | A | 10/1981 | Hieber et al. | |
| 4,349,581 | A * | 9/1982 | Asano et al. | 427/456 |
| 4,469,581 | A | 9/1984 | Asano et al. | |
| 4,797,182 | A | 1/1989 | Beer et al. | |
| 5,073,411 | A * | 12/1991 | Hale | 427/252 |

(Continued)

FOREIGN PATENT DOCUMENTS

| | | | |
|---|---|---|---|
| WO | 0060141 | A1 | 10/2000 |
| WO | 2006133710 | A1 | 12/2006 |

OTHER PUBLICATIONS

Refractory metals. Wikipedia. Downloaded Jun. 2012.*
Danish Search Report for PA 2006 00985 dated Feb. 27, 2007.

(Continued)

*Primary Examiner* — Joseph Miller, Jr.
(74) *Attorney, Agent, or Firm* — McCormick, Paulding & Huber LLP

(57) ABSTRACT

This invention introduces a method for treating a surface of an electrically conductive object with a refractory metal. In one embodiment, the refractory metal is tantalum and the object is a titanium substrate. A surface layer of mixed tantalum and titanium oxides is created by first heating the object and tantalum chloride in a reaction chamber and subsequently heat treating the object in an oxygen containing environment. The electrically conductive object can in a non-limiting way be DSA solutions (Dimensionally Stable Anodes), fuel cells or connector plates.

9 Claims, 1 Drawing Sheet

U.S. PATENT DOCUMENTS

| | | | | |
|---|---|---|---|---|
| 5,314,601 | A | 5/1994 | Hardee et al. | |
| 5,503,663 | A | 4/1996 | Tsou | |
| 2001/0036708 | A1* | 11/2001 | Shin et al. | 438/396 |
| 2004/0075130 | A1 | 4/2004 | Nam et al. | |
| 2005/0042865 | A1* | 2/2005 | Cabral et al. | 438/680 |

OTHER PUBLICATIONS

International Search Report for Serial No. PCT/DK2007/000360 dated Feb. 12, 2008.

* cited by examiner

METHOD FOR TREATING TITANIUM OBJECTS WITH A SURFACE LAYER OF MIXED TANTALUM AND TITANIUM OXIDES

CROSS REFERENCE TO RELATED APPLICATIONS

This application is entitled to the benefit of and incorporates by reference essential subject matter disclosed in International Patent Application No. PCT/DK2007/000360 filed on Jul. 13, 2007 and Danish Patent Application No. 2006 00985 filed Jul. 14, 2006.

FIELD OF THE INVENTION

This invention introduces a method for treating a surface of electrically conductive titanium objects with a surface layer of mixed tantalum and titanium oxides by first heating the objects and tantalum chloride in a reaction chamber and subsequently heat treating the objects in an oxygen containing environment. The electrically conductive objects can in a non-limiting way be DSA solutions (Dimensionally Stable Anodes), fuel cells or connector plates.

BACKGROUND OF THE INVENTION

Traditionally the manufacturing of DSA is based on a substrate provided with a layer of catalyst put upon it, like U.S. Pat. No. 3,929,608 where an electrode is described comprising of an electro-conductive metal core of titanium or a titanium alloy and a catalytic coating on the titanium metal surface, where the coating includes at least one substance from the group consisting of the platinum group metals and their oxides. Another example is U.S. Pat. No. 5,503,663, where a stable catalytic coating solution is prepared using soluble compounds of at least two platinum group metals or at least one platinum group metal and at least one soluble compound of a valve metal. Valve metals are frequently described as metals or alloys with the property that they easily form a passivating oxide film which protects an underlying metal from corrosion, as it is also described in U.S. Pat. No. 4,797,182. The metals could include for example titanium, tantalum, niobium, zirconium, hafnium, vanadium, molybdenum, and tungsten, as in U.S. Pat. No. 4,469,581.

Another example is U.S. Pat. No. 3,616,445 describing a titanium or tantalum base electrode having a protective and electro-catalytic layer applied to the faces exposed to the electrolyte, said protective and electrocatalytic layer consisting of mixtures of solid solutions of valve metal oxides and noble metals. The oxide covers oxides of titanium and tantalum whether in the form of $TiO_2$ and $Ta_2O_5$ or TiOCl and $TaO_2C1$, or other oxides of these metals.

The patents teach that it has been found to be desirable to have mixed oxides in the catalytic coating in order to provide an anode having a longer lifetime. The main causes of failure of such electrodes is attributed to loss of the active coating by dissolution, or is due to passivation by the formation of a highly resistive $TiO_2$ or $Ta_2O_5$ layer between the substrate and the oxide coating, so as to require that the anode be operated at increased potential. However, when they appear as mixed oxides they have a good conductivity.

One known potential solution is to establish a layer of titanium/tantalum oxide at the titanium surface, having a better conductivity than titanium oxide, and with a sufficient stability to prevent the formation of further titanium oxide. This has been described in a number of documents, like U.S. Pat. No. 4,469,581 describing an electrolytic electrode having high durability for use in electrolysis where the generation of oxygen occurs, comprising an electrode substrate of titanium or a titanium-based alloy, an electrode coating of a metal oxide; and an intermediate layer comprising an electrically conductive oxide of tantalum provided between the electrode substrates. Ta2O5 has been confirmed to be suitable as substance forming the intermediate layer.

A number of ways to precipitate the materials onto the conductive object is mentioned in for example U.S. Pat. No. 3,632,498, comprising electrolysis or vacuum-sputtering.

In U.S. Pat. No. 5,314,601 a titanium substrate metal is provided with a highly desirable rough surface characteristic for subsequent coating application. This can be achieved by various operations including etching and melt spray application of metal or ceramic oxide to ensure a roughened surface morphology. Usually in subsequent operations, a barrier layer is provided on the surface of enhanced morphology. This may be achieved by operations including heating, as well as including thermal decomposition of a layer precursor. Subsequent coatings provide enhanced lifetime even in the most rugged commercial environments.

Additionally a layer of pure tantalum could subsequently be placed on the surface and heat treated object, so that the surface layer of tantalum diffuse into the substrate, where another oxidation treatment to oxidize the titanium/tantalum alloy takes place. This is for example described in WO 00/60141 where a tri-layer anode is described with an improved service life when used, where the anode is comprised of a titanium substrate which is roughened and heat treated and subsequently coated with a first coating of tantalum oxide. After the anode is heat treated, it is next coated, preferably by an electrodeposition process with a second coating of platinum. Finally, the anode is coated with a third coating of iridium oxide/tantalum oxide and subsequently heat treated.

A number of processes are used to precipitate the tantalum, such as electrolyse, cladding and CVD. When precipitating tantalum by a CVD, it usually is according to the reaction also described in U.S. Pat. No. 4,294,871:

$$2TACl5+5H2 \rightarrow 2TA+10HCl$$

Such processes are known to be controlled in the separate phases of titanium metal and tantalum metal. Additionally any pollutions (like oils, remains of process chemicals, absorbing layer of oxygen, carbon etc.) in the interface between the two pure metal phases will influence the reaction, so in an industrial process it can be difficult to control the formation of the mixed metal. It is needed to carefully control the level of contamination at the surfaces, and to adapt the thickness of the tantalum layer and the method of heat treatment, to get a satisfactory result, especially in relation to the composition of the titanium/tantalum oxide layer. In practice, because of variations in the roughness of the substrate and the tantalum metal, an irregular thickness of the tantalum layer will be obtained, possibly because of dendrites formed by the metal precipitation or general irregularities in the substrate. Because of the irregular layer thickness it is not possible by the following heat treatment to obtain a complete uniform diffusion between titanium and tantalum. The composition of titanium and tantalum in the surface therefore changes from one area to another on the electrode surface, either on micro or macro level. These areas are characteristic for varying conductivity. In case of operation of the electrode, this irregularity means that the current varies across the surface (microcells are formed), and an increased risk of a local breakdown exists, in the same way it is known for non-tantalum containing electrodes.

BRIEF SUMMARY OF THE INVENTION

The object of this invention is to overcome the above described problems by introducing a hydrogen free environment for the deposition, or precipitation of a refractory metal chloride.

In a hydrogen free deposition environment, refractory metal deposition is dependent on the reaction between titanium and refractory metal chloride, in the following in a non-limiting way exemplified by the refractory metal halide tantalum halide:

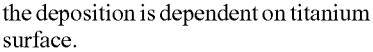

$$4TACl5+5Ti \rightarrow 4TA+5TiCl4$$

Thus tantalum halide (or more general refractory metal halide) cannot deposit as a pure metallic phase, but is forced to integrate in the titanium surface by alloy formation, since the deposition is dependent on titanium being available on the surface.

This reaction is self limiting meaning that the reaction slows down and eventually stops when the surface is covered with increasing amounts of refractory metal/tantalum. As this mechanism controls the reaction locally a uniform tantalum concentration in the surface is ensured.

The present invention solves these problems by introducing a method to treat the surface of a titanium object by a refractory metal halide, like tantalum, that ensures an even concentration of refractory metal at the titanium surface, and thereby prevents any problems concerning formation of micro-cells, thus prolonging the lifetime of the electrically conductive object, like an anode. Unlike standard ways to precipitate refractory metal, the present invention is based on the principle of precipitating refractory metal directly in the titanium phase, thus ensuring that the diffusion between titanium and refractory takes place in a substantially one-phase system without inter-phase.

The method for alloying at least one titanium surface of an electrically conductive object with a refractory metal to obtain an alloyed surface of titanium and refractory metal alloyed surface, said alloy having an increasing gradient towards titanium into the internal of the object, comprises the first step of placing the object and a refractory metal chloride in the reaction chamber of a furnace, heating the object in the furnace at a target temperature for a first time period, In the main embodiment of the invention the refractory metal oxide is a tantalum oxide, and the process of the invention is a reaction between a tantalum-halide, being tantalum in an oxidation level higher than 0, and titanium metal with oxidation level 0. An example is that at a suitable process temperature, then the reaction:

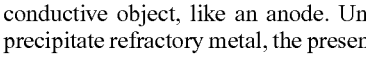

$$4TaCl5(s)+5Ti(s) \rightarrow 4Ta(0)+5TiCl4(g)$$

is able to progress. Compared to a traditional hydrogen reduced CVD process, this may run with a substrate as reduction agent.

Practical experience by using the inventive method to cover the electrically conductive object shows, that it is possible to obtain about three times longer lifespan of electrodes produced by the method as compared to electrodes without the inventive treatment.

Next step of the process is, cooling the reaction chamber for a second time period, removing the object from the reaction chamber.

The diffusion continues during the cooling period with local speeds depending mainly on the local temperature in the object, and the local concentration gradient.

The third step of the process is, subsequent to the second time period the object is heated in an oxidizing atmosphere after it has been removed from the reaction chamber.

Or alternatively, adding oxidizing compounds to the furnace chamber before or during the first time period.

Hereby the outer surface layer is formed into a mixed layer of titanium oxide and tantalum oxide.

DETAILED DESCRIPTION OF THE PREFERRED EMBODIMENTS

Figure 1:
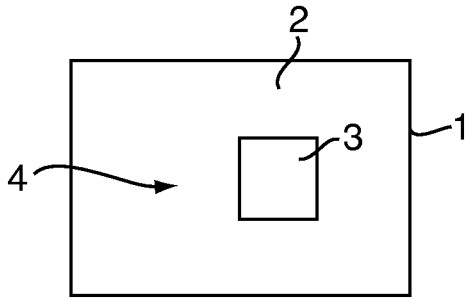
FIG. 1 shows a simple illustration of the titanium object in the furnace and with tantalum chloride supplied to the furnace.

FIG. 1 shows a simple illustration of the invention, where an electrically conductive object (3) is positioned in the reaction chamber (2) of the furnace (1). The object (3) has at least one surface of titanium. The substrate reaction material (4) is in the preferred embodiment of the invention TaCl5 supplied in some solid state, preferable as a powder.

The main process of the invention is a reaction between a tantalum-halide, being tantalum in an oxidation level higher than 0, and titanium metal with oxidation level 0. An example is that at a suitable process temperature (the target temperature), then the reaction

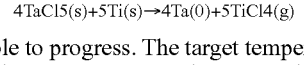

$$4TaCl5(s)+5Ti(s) \rightarrow 4Ta(0)+5TiCl4(g)$$

is able to progress. The target temperature is preferably chosen between 880-930 degrees Celsius, or preferably 900 degrees Celsius.

Depending on factors like the size of the objects (3) and the target temperature, the heating continues for a few minutes, or possibly even less than one minute.

The precipitated tantalum layer would preferably now have achieved a thickness of less than 1 micrometer.

When the reaction process has ended the furnace is cooled down over 2-3 hours before removing the object from the reaction chamber.

Figure 2A:
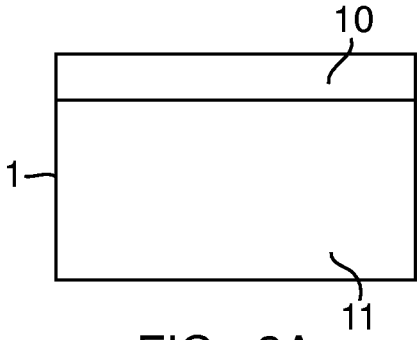
FIG. 2A shows the titanium object with a precipitated surface layer of tantalum.

An alloy layer of tantalum and titanium now covers the titanium surface of the object (3). FIG. 2A shows the object immediately after the reaction has ended, where the outer part (10) of the surface basically consists of tantalum, and the inner part (11) is mainly titanium.

Figure 2B:
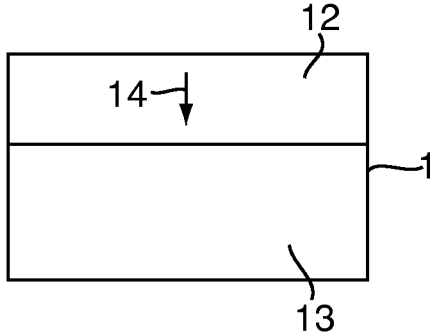
FIG. 2B shows the titanium object with a surface layer of alloyed titanium and tantalum.

FIG. 2B shows the same object (3) after the furnace has cooled down over some hours. Now diffusion has ensured that also the outer surface (12) is a mix of alloyed tantalum and titanium, the inner part (13) is still mainly titanium, as there is a gradient (14) of decreasing tantalum towards the inner part (13).

Depending on the target temperature the tantalum atoms diffuse into the substrate with a velocity also depending on the local differences in the metal phase concentration, and since the diffusion follows Ficks' law, the local concentration gradients in the surface will even out. Precipitation of the following tantalum occurs as a reaction between the tantalum halide and the titanium/tantalum alloy. The speed of precipitation is determined by the alloy composition, if there are areas on the surface with a substantially low amount of tantalum, the reaction time will progress faster than in areas with a substantially high amount of tantalum. Since areas with a low amount of tantalum have the largest affinity (faster reaction), the process actively evens out the concentration differences in the surface, and since the diffusion conditions and precipitation conditions counteract concentration gradients in the surface, it is achieved that the amount, or effect, of micro elements in the electrically conductive subject is reduced when in operation.

Figure 3:
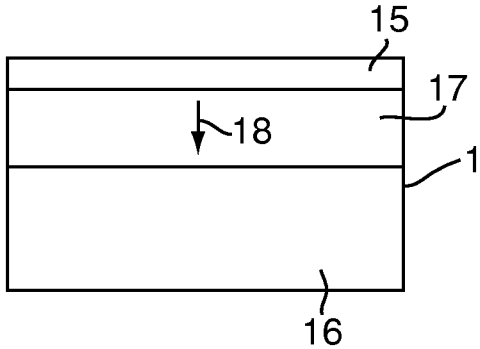
FIG. 3 shows the titanium treated object after it has been heat treated in an oxygen containing atmosphere.

The next step is the formation of oxides on the surface of the object. This is achieved by a heat treatment in an oxygen containing environment. FIG. 3 shows the object (3) now comprising a mixed TiO and Ta2O outer layer (15), a mainly titanium inner part (16) and an alloyed layer (17) of titanium and tantalum in between, having a gradient (18) of decreasing tantalum concentration into the inner of the object.

Compared to a traditional hydrogen reduced CVD process, this may run with a substrate as reduction agent. During the formation of the first atomic layer the surface of the substrate partly or completely consists of 'free' titanium atoms absorbing tantalum atoms onto the surface of the substrate. When the first atomic layer is formed, the surface consists of an alloyed mixture of titanium and tantalum.

The invention is not limited to the use of TaCl5, other chlorides and halides of tantalum may also be used, like TaCl4, TaCl5, Ta2Cl10, or a mixture of chlorides or halides in varying oxidation states, or possibly, also non-tantalum chloride compounds may be added to the furnace. The important aspect of the invention is not which kind of chloride mixture composition is feed to the system, the gas in the reaction chamber (2) that is to be reacted with the substrate material, must however contain a concentration of tantalum chloride.

The invention is not limited to chlorides of tantalum, but any refractory metal chloride might also be used, where the refractory metals include, tungsten, W, tantalum, Ta, molybdenum, Mo, niobium, Nb, and zirconium.

The total amount of tantalum chloride added must be equal to a gas amount larger than 0.001 vol % of the volume of the furnace chamber. Since tantalum chloride is consumed the total chloride amount added may exceed an amount larger than a gas amount 100 vol %. In a mixture of components (e.g. tantalum chloride, non tantalum metal chloride and a carrier gas like e.g. Argon) the Tantalum chloride concentration should be at least 0.5% of the components processed in the process.

The tantalum chloride or tantalum containing mixture may be added to the furnace in solid, liquid or gas form (or a multiphase form). A solid containing liquid may e.g. be initially added as well as a gas may be added. The important issue is that some or all of the tantalum chloride appears in gas form during at least a part of the period of the time at the target temperature, preferably at least 10% of the time.

The object (3) and the tantalum chloride (4) may be placed in the reaction chamber (2) before the furnace temperature has been raised to the target temperature, or they may be feed to the reaction chamber (2) when it is preheated to or above the target temperature.

A further aspect of the invention is that the remains of the processes is liquid titanium chloride and is therefore easy to drain from the reaction chamber by a pump or by freezing it.

A further aspect of the invention is the possibility to introduce a continuously running production plant. The furnace is then preferably preheated to the target temperature as the titanium objects are positioned in the reaction chamber. The substrate tantalum chloride is then supplied continuously or in small packages, and the liquid titanium chloride is drained as it is produced.

In another embodiment of the invention the internal sides of the furnace being the walls of the reaction chamber, could themselves be made of tantalum, an alloy of tantalum, or any other tantalum containing material.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method for alloying a titanium surface of an electrically conductive object with a refractory metal to obtain an alloyed surface of titanium and refractory metal, said alloyed surface having an increasing gradient towards titanium into the internal of the object, said process comprising the steps:

placing the object and a refractory metal halide in a reaction chamber of a furnace, heating the object in the reaction chamber at a target temperature over a first time period, cooling the reaction chamber over a second time period, and removing the object from the reaction chamber, wherein the refractory metal halide is TaCl5 and the tantalum is precipitated using the net reaction 4 TaCl5(s)+5 Ti(s)→4 Ta(0)+5 TiCl4(g), where Ta(0) indicates that tantalum is present in oxidation state zero.

2. The method as in claim 1, wherein the supplied tantalum pentachloride is solid tantalum pentachloride.

3. The method as in claim 2, wherein the first time period is 3-5 minutes.

4. The method as in claim 3, wherein the tantalum pentachloride is supplied to the reaction chamber in the form of a powder or an ampoule exploding in the reaction chamber.

5. The method as in claim 1, wherein the formed TiCl4 is removed by pumping, freezing, condensing or through a passive outlet.

6. The method as in claim 1, wherein the temperature for the first time period is within 880-1200 degrees Celsius.

7. The process as in claim 6, wherein the temperature for the first time period is between 915-930 degrees Celsius.

8. The method as in claim 1, where the object subsequent to the second time period is heated in an oxidizing atmosphere after it has been removed from the reaction chamber.

9. The method as in claim 1, where oxidizing compounds are added to the reaction chamber before or during the first time period.

* * * * *